US006165083A

United States Patent [19]

Stenger et al.

[11] Patent Number: 6,165,083

[45] Date of Patent: Dec. 26, 2000

[54] GOLF PUTTING AID

[75] Inventors: Sydney L. Stenger, 400 W. Cummings Park, Woburn, Mass. 01801; Erick R. Moody, Coral Springs, Fla.

[73] Assignee: Sydney L. Stenger, Woburn, Mass.

[21] Appl. No.: 09/274,461

[22] Filed: Mar. 22, 1999

[51] Int. Cl.[7] ..... A63B 57/00

[52] U.S. Cl. ..... 473/404; 33/366.26; 473/241

[58] Field of Search ..... 473/404, 241; 33/366.26, 366.27, 365, 391, 370, 366.24

[56] References Cited

U.S. PATENT DOCUMENTS

| | | | |
|---|---|---|---|
| 3,584,387 | 6/1971 | Sturm | 33/366.26 |
| 3,751,819 | 8/1973 | Dixon | 473/404 |
| 4,079,520 | 3/1978 | Davis . | |
| 4,082,286 | 4/1978 | La Breche . | |
| 4,179,125 | 12/1979 | Cone et al. . | |
| 4,260,151 | 4/1981 | Weaver . | |
| 4,824,114 | 4/1989 | Catalano . | |
| 4,843,725 | 7/1989 | Harris . | |
| 4,930,787 | 6/1990 | Nobles, Jr. | 473/404 |
| 4,984,791 | 1/1991 | Labell . | |
| 5,094,004 | 3/1992 | Wooten | 33/366.26 |
| 5,209,470 | 5/1993 | Cimaroli et al. . | |
| 5,313,713 | 5/1994 | Heger et al. | 33/366.26 |
| 5,326,096 | 7/1994 | H'Doubler . | |
| 5,330,179 | 7/1994 | Hampel . | |
| 5,403,001 | 4/1995 | Skorpinski . | |
| 5,488,779 | 2/1996 | Schultheis et al. | 33/366.26 |
| 5,492,329 | 2/1996 | Kronin . | |
| 5,509,657 | 4/1996 | Guthry . | |
| 5,707,299 | 1/1998 | McKenna . | |
| 5,755,623 | 5/1998 | Mizenko . | |
| 5,792,015 | 8/1998 | Hoyt et al. | 473/404 |
| 5,820,476 | 10/1998 | Amato . | |

*Primary Examiner*—Mark S. Graham
*Attorney, Agent, or Firm*—Price, Heneveld, Cooper, DeWitt & Litton

[57] ABSTRACT

A golf putting aid is disclosed that includes a level detector for measuring a slope of a golf green and for generating an electrical signal representing the measured slope, a control circuit coupled to the slope measuring sensor for receiving the electrical signal and for generating an indicator signal representing information that will aid a golfer while making a putt on the golf green, and an indicator coupled to the control circuit for receiving the indicator signal and for indicating the information represented by the indicator signal to a golfer. Preferably, the level detector measures the slope of a golf green at at least two locations and generates electrical signals representing the measured slope at each location. The control circuit then processes the electrical signals to compute an offset distance from the hole at which the golfer should aim so as to compensate for the measured slopes of the green. This offset distance may then be indicated to the golfer through the indicator, which may be an audible indicator or a visual display.

19 Claims, 4 Drawing Sheets

GOLF PUTTING AID

BACKGROUND OF THE INVENTION

The present invention generally relates to a device for measuring the slope of a green on a golf course. More particularly, the present invention relates to a golf putting aid for measuring the slope of a golf course green and providing a golfer with an indication of a lateral offset distance from the hole where the golfer should aim his or her putt so as to compensate for the measured slope of the green.

Many devices have been developed to assist golfers in aligning their putts on sloped greens. In general, these devices provide the golfer with some indication of the degree of slope of the green at the particular location where the device is positioned. Most of these devices utilize a bubble in a liquid-filled tube for this purpose. Such devices may be attached to or physically incorporated in the shaft of a putter. Examples of such devices are disclosed in U.S. Pat. Nos. 4,079,520; 4,179,125; 5,509,657; 5,755,623; and 5,820,476. Alternatively, such leveling devices may be physically incorporated into the head of a putter. Examples of such devices are disclosed in U.S. Pat. Nos. 4,824,114; 5,209,470; 5,492,329; and 5,707,299. The slope measuring devices may also be separate devices that are not attached or incorporated within a putter. Examples of such devices are disclosed in U.S. Pat. Nos. 5,326,096 and 5,403,001.

All of the slope measuring devices described above require that the putter or separate slope measuring device be laid down on the green so as to provide an indication of the relative slope of the green. However, none of the devices described in the above patents informs the golfer where he or she should aim his or her ball relative to the hole so as to compensate for the slope in the green. U.S. Pat. Nos. 4,260,151 and 4,984,791 disclose devices that the golfer holds in his or her hand above the surface of the green so as to look through the device and align it with the slope of the green and the hole. Based upon the alignment of the device, the golfer is provided with some indication as to where to aim when putting so as to compensate for the slope of the green. These devices, however, do not take into account the distance to the cup, which obviously will affect the extent of lateral movement of the ball due to the slope of the green.

To take into account the distance of the putt, devices have been constructed that include a scale for determining the number of inches the ball will break as a result of the slope for various distances of putts. Examples of such devices are disclosed in U.S. Pat. Nos. 4,082,286 and 5,330,179.

While the above-described devices supply the golfer with some information that may be useful to more accurately putt on a green with a constant slope between the ball and the cup, these devices are of little value when the slope varies. For example, even the more sophisticated devices that provide the golfer with the number of inches the ball will break for different distances would not be the least bit accurate or helpful if the green had a non-uniform slope or if it were sloped back the opposite direction somewhere within the line of the putt.

SUMMARY OF THE INVENTION

Accordingly, it is an aspect of the present invention to provide a golf putting aid that provides a more accurate indication to the golfer as to where to aim, so as to compensate for any break that will be caused by the slope(s) in the green. An additional aspect of the present invention is to provide a golf putting aid that allows the golfer to take multiple measurements of the slope of the green for any given putt of any distance and thereby provide the golfer with a more accurate indication of where to aim his or her putt.

To achieve these and other aspects and advantages, the golf putting aid according to the present invention comprises a level detector for measuring a slope of a golf green and for generating an electrical signal representing the measured slope, a control circuit coupled to the level detector sensor for receiving the electrical signal and for generating an indicator signal representing information that will aid a golfer while making a putt on the golf green, and an indicator coupled to the control circuit for receiving the indicator signal and for indicating the information represented by the indicator signal to the golfer. Preferably, the level detector measures a slope of a golf green at at least two locations and generates electrical signals representing the measured slope at each location. The control circuit then processes the electrical signals to compute an offset distance from the hole at which the golfer should aim so as to compensate for the measured slopes of the green. This offset distance may then be indicated to the golfer through the indicator, which may be an audible indicator or a visual display.

These and other features, advantages, and objects of the present invention will be further understood and appreciated by those skilled in the art by reference to the following specification, claims, and appended drawings.

DETAILED DESCRIPTION OF THE PREFERRED EMBODIMENT

As will be described in detail below, the golf putting aid of the present invention includes a level detector for measuring a slope of a golf green and for generating an electrical signal representing the measured slope. The inventive putting aid further includes a control circuit coupled to the level detector for receiving the electrical signal and for generating an indicator signal representing information that will aid a golfer while making a putt on the golf green, and an indicator coupled to the control circuit for receiving the indicator signal and for indicating the information represented by the indicator signal to the golfer. The indicator may be a display, such as a liquid crystal display device, and/or may be an audio circuit including a speaker for audibly indicating the information to the golfer.

The information provided to the golfer from the golf putting aid may include an offset distance from the hole at which the golfer should aim so as to compensate for the measured slope of the green. The information may further include a plurality of offset distances corresponding to different putting distances. The information provided to the golfer by the golf putting aid may alternatively or additionally include the measured slope angle as measured by the level detector.

Preferably, the level detector may measure a slope of a green at at least two locations and generate electrical signals representing the measured slope at each location. The control circuit may then receive and process the electrical signals to compute an offset distance from the hole at which a golfer should aim so as to compensate for all of the measured slopes of the green and then generate an indicator signal representing the computed offset distance. By configuring the golf putting aid to allow a golfer to measure the slope of the green at various locations intermediate the ball and the cup, and by integrating the measured slopes so as to compute an offset distance from the cup to compensate for all of the measured slopes, much more accurate information may be provided to the golfer to help the golfer make the putt.

As will also be described in detail below, the golf putting aid of the present invention includes means for calibrating the level detector. Such calibration means allows the golfer to place the putter having the golf putting aid mounted thereon on a known level surface and simply press a user switch to inform the golf putting aid that it is being calibrated. The golf putting aid then stores its current slope reading as a calibration reference point for future readings when on a sloped surface. Thus, the golf putting aid of the present invention does not require any mechanical manipulation of the manner by which it is mounted to a putter for purposes of calibrating the level detector and hence provide more accurate readouts.

Figure 1:
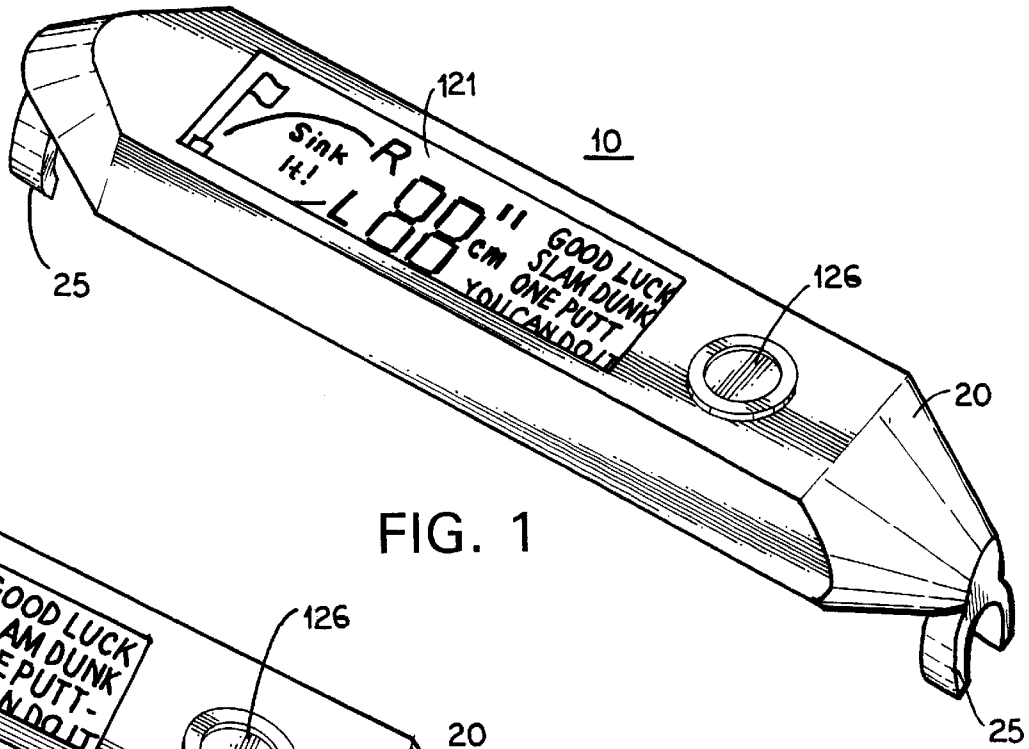
FIG. 1 is a perspective view of the golf putting aid constructed in accordance with the present invention.
Figure 2:
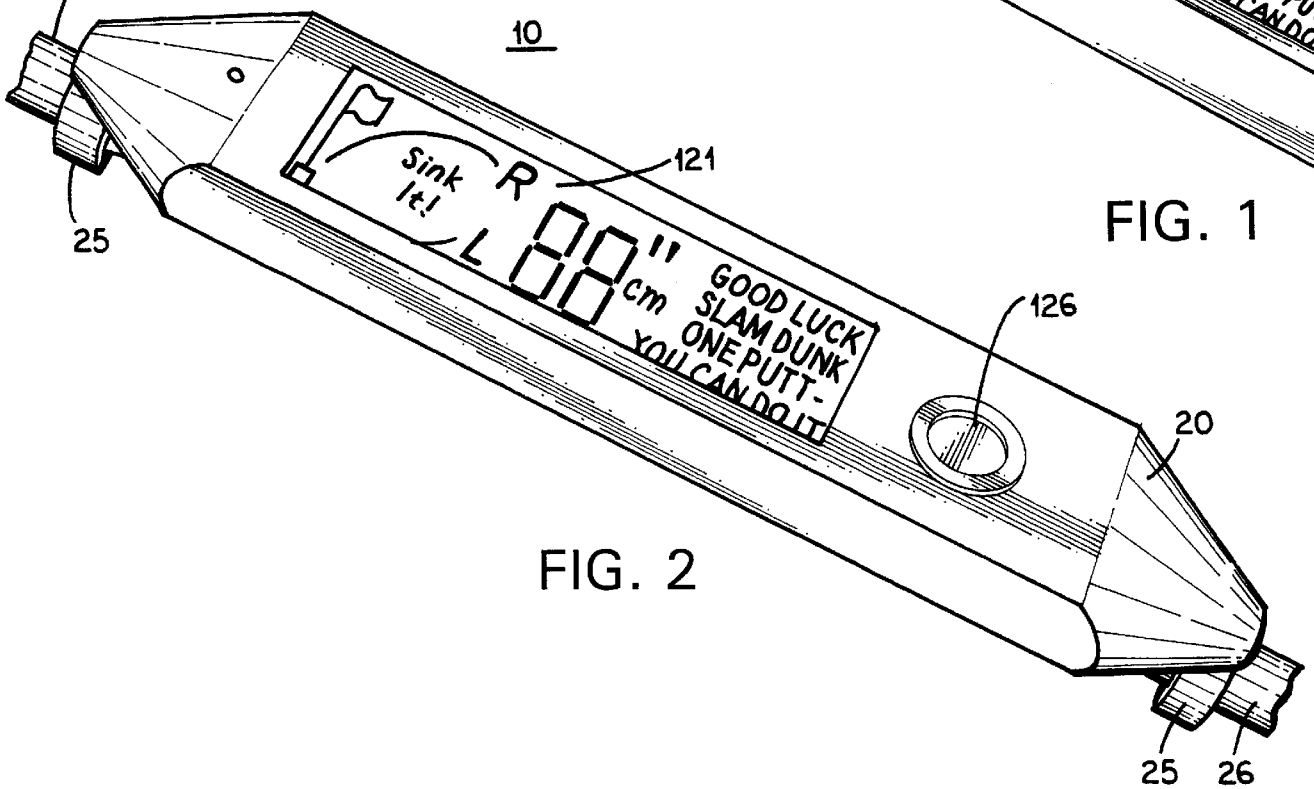
FIG. 2 is another perspective view of the golf putting aid of the present invention as it would appear attached to the shaft of a putter.

FIG. 1 shows an exemplary illustration of the golf putting aid 10 constructed in accordance with the present invention. As illustrated, golf putting aid 10 includes a housing 20 having one or more mounting clips 25 formed in one side thereof for mounting to the shaft of a putter. Mounting clips 25 are preferably formed of a resilient plastic integrally molded with housing 20. Resilient mounting clips 25 are configured to easily snap onto and off from the shaft 26 of a putter, as shown in FIG. 2.

Figure 3:
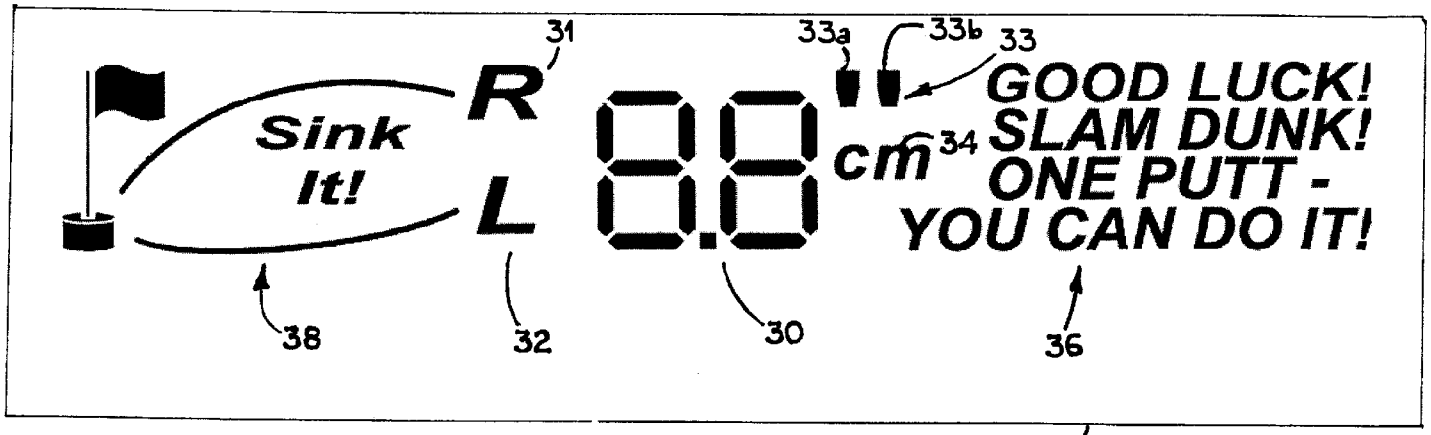
FIG. 3 is a front view of an exemplary display of the golf putting aid of the present invention.

As will be further described below, golf putting aid 10 may include a display 121 for displaying information to the golfer. As shown in FIG. 3, display 121 may be a liquid crystal display including various bits of information that is displayed when the corresponding display segments are activated. For example, display 121 may include two seven-segment numerical display elements 30 that are used to display the calculated offset distance. Further, display 121 may include R and L display segments 31 and 32, respectively, one of which is activated to inform the golfer whether the offset distance corresponds to the right or left of the cup. Further, display 121 includes unit indicator display segments 33 and 34 for displaying whether the current offset distance is in centimeters/meters or inches/feet. Unit display segment 33 includes two separate segments 33*a* and 33*b*. When both segments 33*a* and 33*b* are activated and hence displayed, the unit of measurement is displayed in inches. On the other hand, if only segment 33*a* is activated, the display indicates that the currently displayed distance is measured in feet. To display various offset distances for different putting distances, the control circuit may display various distances in sequence by first displaying the distance of the putt and then displaying the offset distance for that distance of putt. The control circuit may then sequence through the various offset distances and incremental distances of putt at a specified rate or it may respond to user input via user switch 126. Display 121 may further include other display segments for displaying words of encouragement as referenced in FIG. 3 by reference numerals 36 and 38. Although display 121 is shown in FIGS. 1 through 3 as having a particular display configuration, it will be appreciated by those skilled in the art that the display may take various forms and include various types of display devices.

Golf putting aid 10 preferably includes user input means in the form of a depressable button 126 mounted on the top or any surface of housing 20. Further, golf putting aid 10 may include a serial or parallel port 128 (FIG. 4) serving as a programming interface so as to allow the control circuit within golf putting aid 10 to be programmed from an external source. Insofar as golf putting aid 10 includes electrical components, housing 20 is preferably provided with a battery door (not shown) to allow insertion and replacement of a battery used to power the electrical components.

Figure 4:
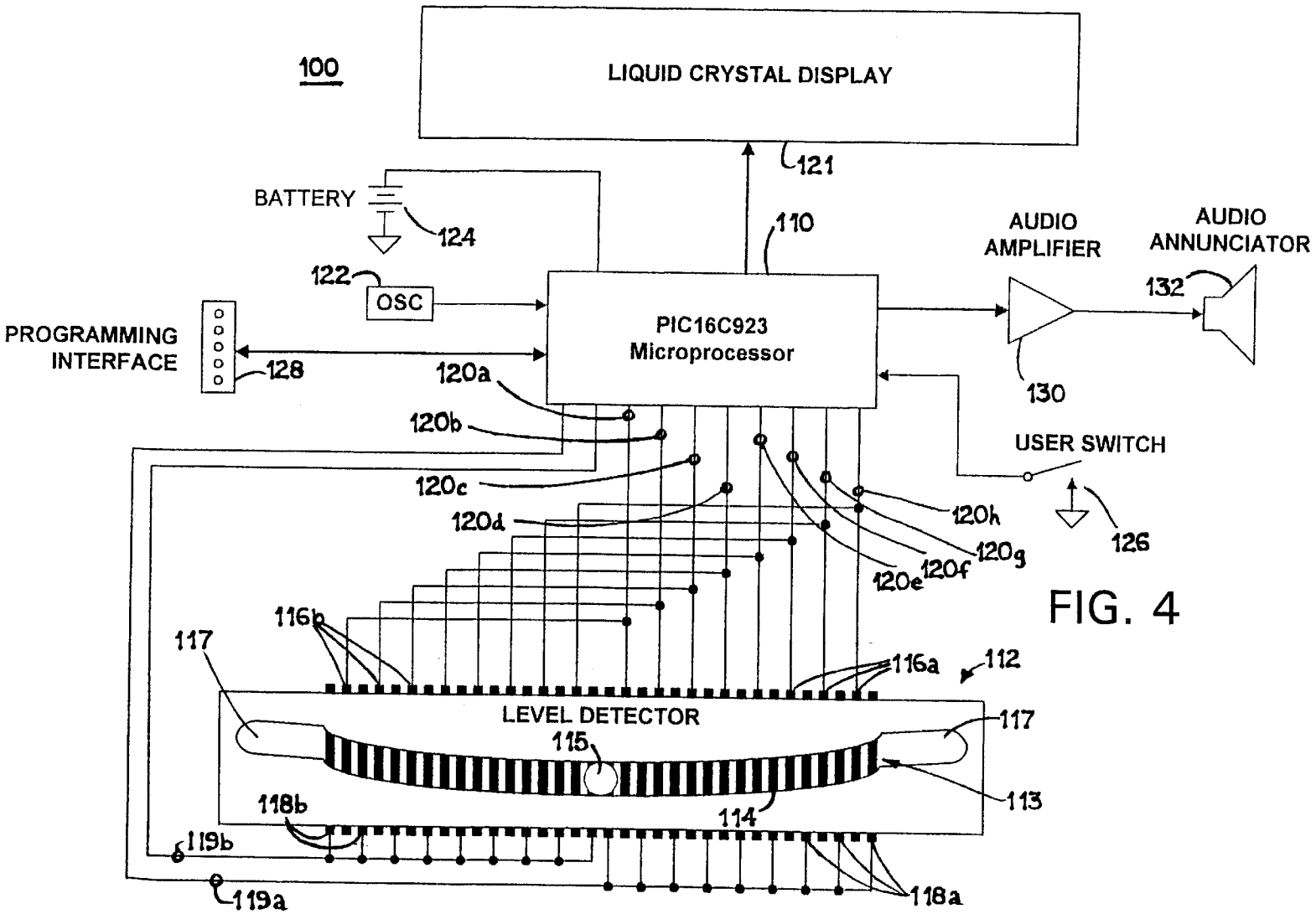
FIG. 4 is an electrical circuit diagram in block and schematic form illustrating the electrical circuitry of the inventive golf putting aid.

FIG. 4 shows an electrical circuit diagram of the electrical circuit 100 of the inventive golf putting aid 10. As mentioned above, golf putting aid 10 includes a control circuit. This control circuit is preferably implemented using a microprocessor 110, such as part No. PIC16C923 available from Microchip. Alternatively, the control circuit could be constructed using a circuit of discrete or integrated analog or digital components.

As also mentioned above, the golf putting aid of the present invention includes a level detector, which is generally referenced in FIG. 4 by reference numeral 112. Level detector 112 includes a chamber 113 having a curved interior surface 114 and an electrically conductive movable element, such as a steel ball 115 or rod positioned inside chamber 113 for travelling across curved interior surface 114. Curved surface 114 is preferably constructed such that ball 115 will roll within chamber 113 and come to a rest in a position along curved surface 114 that corresponds to the slope that is being measured. Level detector 112 further includes a plurality of electrical contacts 116 and 118 provided in chamber 113 and extending outward from level detector 112 for coupling to microprocessor 110. Electrical contacts 116 and 118 are preferably disposed in parallel to one another and perpendicular to a direction of travel of electrically conductive ball 115. The electrical contacts are also spaced apart from one another by a distance related to the diameter of electrically conductive ball 115, such that an electrically conductive path is formed between two adjacent electrical contacts when electrically conductive ball 115 is disposed therebetween. Thus, in the manner described in more detail below, microprocessor 110 may sense the position of ball 115 within chamber 113 and hence determine the relative slope to be measured.

In general, microprocessor 110 applies a voltage to every other one of the electrical contacts while monitoring the voltage at each of the other electrical contacts. To allow microprocessor 110 to perform this task more efficiently, microprocessor 110 may be programmed to perform this task in a multiplexed fashion. For example, as shown in FIG. 4, microprocessor 110 may apply a voltage level alternatingly over lines 119*a* and 119*b* and thereby provide a voltage level to a first half 118*a* of electrical contacts 118*a* and a second half 118*b* of electrical contacts 18*b*. In this manner, electrical contacts 116 may also be split into two or more groups, with each electrical contact 116*a* in a first group paired with each electrical contact 116*b* in a second group. The paired electrical contacts in groups 116*a* and 116*b* may be coupled together to a common input terminal 120*a* through 120*h* of microprocessor 110.

In operation, microprocessor 110 may first supply the high voltage on line 119*a* while not supplying the same high voltage on line 119*b*. Microprocessor 110 then reads the voltage levels at input terminals 120*a* through 120*h*. If a high voltage level is detected at one of these input terminals, microprocessor 110 can immediately determine that conductive ball 115 is not in any position corresponding to the electrical contact terminals 116*b* of the second group, but rather is lying between the electrical contact terminal 116*a* of the first group and an adjacent contact terminal 118*a* connected to line 119*a*. If microprocessor 110 does not detect a high voltage level at any of its input terminals 120*a* through 120*h* when a high voltage is applied on line 119*a*, it then supplies a high voltage level on line 119*b* to the second group of contact terminals 118*b* while grounding line 119*a*. If a high voltage level is then sensed at one of terminals 120*a* through 120*h*, microprocessor 110 may then determine where conductive ball 115 is relative to the contact terminals. If no high voltage is again sensed, microprocessor 110 may determine that conductive ball 115 is not in the track, but rather is resting in an end portion 117 of chamber 113. Ball 115 comes to rest in one of the end portions 117 when the shaft of the putter is vertical or otherwise inclined at an angle that is greater than that of which any green would be likely to be sloped. As will be explained further below, when ball 115 is in one of end portions 117 of chamber 113, microprocessor 110 enters a sleep mode, since it is clear that the golfer is not currently using the golf putting aid to measure the slope of a green.

Electrical circuit 100 also preferably includes a display 121, which may be a liquid crystal display or any other form of display. Display 121 is coupled to microprocessor 110, which drives the display with the signal obtained from an oscillator 122. Additionally, microprocessor 110 controls display 121 so as to display certain information to the golfer.

Electrical circuit 100 may additionally or alternatively include an audio circuit including an audio amplifier 130 and a speaker 132 coupled to microprocessor 110. Microprocessor 110 may then be programmed to generate synthesized voice messages from stored voice message segments so as to audibly announce putting distances, offset distances, and/or slope angle to the golfer.

As described above, golf putting aid 10 may include a user switch 126 that is coupled to microprocessor 110. User switch 126 allows the golfer to input information to the microprocessor 110. Specifically, user switch 126 may be used to change the mode of operation of the golf putting aid. For example, the switch may be operated to cause microprocessor 110 to enter a calibration mode whereby the level detector is calibrated, or to inform microprocessor 110 that the next slope to be measured is to be integrated with the previously measured slope(s). Alternatively, if microprocessor 110 is programmed to assume, as a default, that each successive slope is to be integrated, switch 126 may be used as a reset switch so as to cause microprocessor 110 to clear any previously stored measured slopes from its memory and start anew.

As also shown in FIG. 4, electrical circuit 100 further includes a battery 124 coupled to microprocessor 110 for providing power to the microprocessor and thereby to all the other electrical components of the circuit. Additionally, electrical circuit 100 may optionally include a programming interface 128 having an external port on the housing 20 (FIG. 1) for coupling to an external computer or other device.

Figure 6:
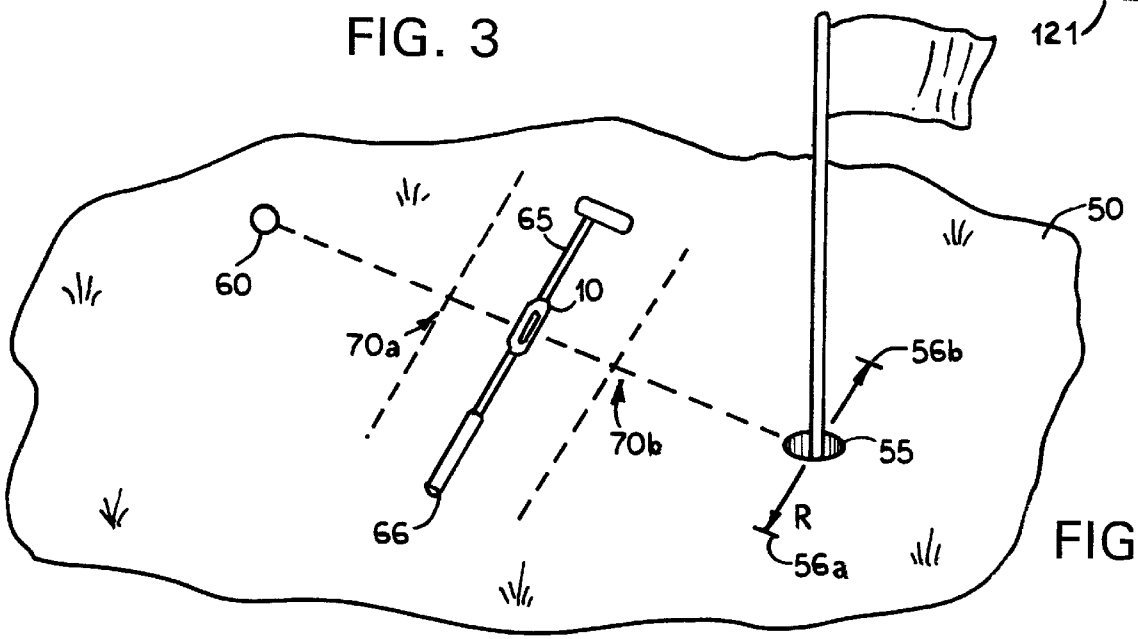
FIG. 6 is a perspective view of a golf green illustrating use of the inventive golf putting aid.
Figure 5:
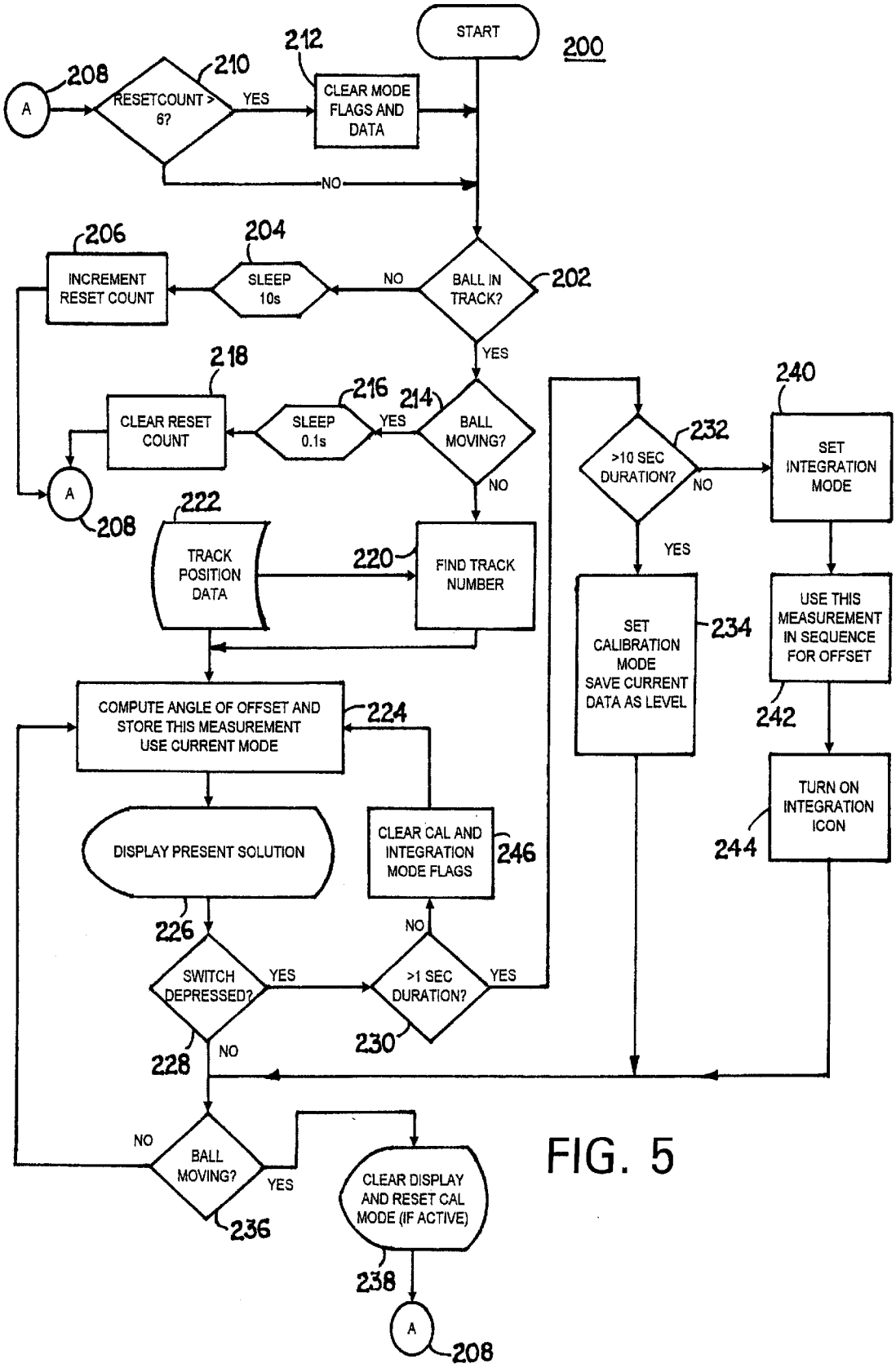
FIG. 5 is a flow chart illustrating the operations performed by the microprocessor of the electrical circuit of the inventive golf putting aid.

Having generally described the hardware components of the electrical circuit 100 shown in FIG. 4, the functions performed by microprocessor 110 are described below with reference to FIGS. 5 and 6. Referring first to the flow diagram shown in FIG. 5, the programmed process 200 performed by microprocessor 110 will now be described.

Microprocessor 110 begins process 200 by determining in step 202 whether ball 115 is in the track. If the ball is not in the track, but rather is in one of end portions 117 of chamber 113, microprocessor 110 performs step 204 by entering a sleep mode for a predetermined time period of, for example, ten seconds. As noted above, ball 115 would not be in the track and would be in one of end portions 117 when the putter shaft is in a vertical position or inclined at an angle that is greater than that of any green. This would be the initial state of the golf putting aid prior to use. After sleeping for a predetermined time period in step 204, microprocessor 110 then executes step 206 whereby it increments a reset count that is initially set at zero. As will be explained further below, the reset count is used to determine how many consecutive loops through the process that microprocessor 110 enters the prolonged sleep state in step 204. After incrementing the reset count in step 206, microprocessor 110 proceeds to step 210 as indicated by connector A (208) in FIG. 5. In step 210, microprocessor 110 determines whether the reset count is greater than a predetermined threshold of, for example, six. If the threshold is exceeded, microprocessor 110 clears any mode flags that have been set and any data that has been stored in step 212 prior to proceeding back to step 202. If, in step 210, microprocessor 110 determines that the reset count does not exceed the threshold, microprocessor 110 simply proceeds to step 202 without clearing any mode flags or data. Microprocessor 110 again determines in step 202 whether or not ball 115 is in the track. Provided that the ball is not in the track, microprocessor 110 continues to loop through steps 202 through 212 in the manner described above. Thus, prior to use by the golfer, microprocessor 110 simply continues to loop through steps 202 through 212 until such time that it determines in step 202 that the ball has entered the track, thereby signaling that the golfer may now be attempting to use the golf putting aid.

Prior to initial use, golfers are instructed to calibrate the inventive golf putting aid. Specifically, the golfer is instructed to locate a surface that is known to be level (i.e., the golfer may use a bubble level or any other conventional level detector to determine whether the surface is known to be level). Upon movement of the putter during placement on the level surface, ball 115 moves from its resting position in one of end portions 117 into the track where the electrical contacts are located. By selectively applying a high voltage level on one of lines 119*a* and 119*b* and monitoring input ports 120*a* through 120*h*, microprocessor 110 may determine whether the ball has entered the track. Thus, microprocessor 110 would then proceed to step 214 from step 202 once the ball has been detected. In step 214, microprocessor 110 determines whether the ball is still moving by determining whether the input port 120*a* through 120*h* at which the high voltage level was detected has changed or is presently changing. If the ball is still moving (initially it would still be moving until the putter is at rest on the level surface), microprocessor 110 proceeds to step 216, whereby it enters a sleep mode for a short predetermined time period of, for example, one-tenth of a second. Microprocessor 110 then clears the reset count and proceeds back to step 210 where it determines that the reset count is less than the predetermined threshold prior to proceeding back to step 202 to determine whether the ball is still in the track.

Assuming that the ball is still in the track, microprocessor 110 returns to step 214 to determine whether the ball is still moving. So long as the ball is still moving, microprocessor 110 loops through steps 202, 214, 216, 218, and 210.

Once the golfer has placed the putter horizontally on the known level surface with the display pointed upward, ball 115 stops moving and comes to rest within the track. Microprocessor 110 may determine that the ball has come to rest by monitoring input ports 120*a* through 120*h* and determining that the same input port has maintained a high voltage level for a predetermined time period.

When microprocessor 110 determines that the ball has come to a rest in the track, it identifies the track number in step 222. Initially, a track number is assigned to each of the electrical contacts, assuming that the center two contacts represent the position the ball would be in when the device is measuring a level surface. Hence, upon finding the track number in step 220, microprocessor 110 accesses the initial default track position data 222 to identify a track number corresponding to the location of the ball in its current at-rest position.

Next, microprocessor 110 performs step 224 by computing the angle of the slope and the offset distance for one or more putting distances. This information is stored and then displayed on display 121 in step 226. If golf putting aid 10 were mounted on the shaft of the putter, such that ball 115 rested between the two centermost electrical contacts in the track when the putter was placed on a known level surface, the displayed offset distances would be zero for all putting distances. However, because the putter shaft may be inclined at an angle due to varying putter head configurations, club lengths, and grip thicknesses, it is likely that an offset distance will be displayed because ball 115 will likely be resting somewhere other than between the centermost electrical contacts. Thus, if an offset distance is displayed, the golfer is instructed to depress user switch 126 for a time period of, for example, greater than ten seconds.

Thus, after displaying the computed offset distances, microprocessor 110 determines in step 228 whether switch 126 has been depressed. If it has been depressed, microprocessor 110 determines in step 230 whether switch 126 has been continuously depressed for greater than one second. If so, microprocessor 110 proceeds to step 232 where it determines whether switch 126 has been continuously depressed for more than ten seconds. Assuming that the user is currently calibrating the golf putting aid, switch 126 would be depressed for greater than ten seconds, and microprocessor 110 would detect this in step 232 and then proceed to step 234 where it would set the calibration mode flag and save the currently sensed track number as representing a level condition. As will be described further below, this calibration data identifying a level condition is then used as a reference for all further slope measurements until such time that the device is recalibrated.

After step 234, microprocessor 110 proceeds to step 236 whereby it determines whether ball 115 is again moving. If ball 115 is not moving, microprocessor 110 proceeds to step 224 and computes the angle of the slope and the offset distances. Microprocessor 110 then displays the offset distances, which should all be zero immediately following calibration. Microprocessor 110 then proceeds to step 228 where it determines that switch 126 is no longer being depressed and thus proceeds to step 236 to again determine whether the ball is moving. So long as the ball is not moving, microprocessor 110 will continue to loop through steps 224, 226, 228, and 236.

Once the user has calibrated the putter, he or she is likely to pick up the putter and hence the ball would begin moving and microprocessor 110 would detect this movement in step 236. Upon detecting that the ball is moving in step 236, microprocessor 110 would proceed to step 238 whereby it would clear the display and reset the calibration mode flag if it had been set in step 234. Then, microprocessor 110 would proceed back to step 210 as indicated by connector A (208). Because the ball had been in the track throughout the calibration procedure, the reset count would remain cleared as last performed in step 218, and microprocessor 110 would proceed to step 202 to determine whether the ball is in the track. Assuming the golfer has placed the putter in his or her golf bag at that time, the ball would no longer be in the track, and microprocessor 110 would loop through steps 202 through 212 in the manner described above until such time that the putter is removed from the bag and placed on the surface of a green.

To measure the slope of a green and hence receive the computed offset distances, the golfer is instructed to place the putter 65 (FIG. 6) on the surface of the green in the same manner in which the putter was laid on the known level surface during calibration. The golfer is further instructed that the putter 65 be oriented with its shaft perpendicular to a line extending between ball 60 and the center of cup 55. If the slope of the green is uniform throughout the distance between ball 60 and cup 55, the golfer is instructed to position putter 65 in a location 66 halfway between ball 60 and cup 55. During placement of putter 65 on the surface of green 50, microprocessor 110 determines in step 214 that ball 115 is now moving and hence proceeds through steps 216, 218, 210, and 202 in the manner described above until such time that microprocessor 110 determines in step 214 that ball 115 has come to rest. When putter 65 is resting on the surface of green 50 and ball 115 has come to rest, microprocessor 110 then determines the track number corresponding to the electrical contacts that are bridged by the electrically conductive ball 115 prior to proceeding to step 224.

In step 224, microprocessor 110 determines how many tracks (i.e., electrical contacts) ball 115 is spaced away from those tracks where ball 115 had come to rest during the calibration routine. This difference in track numbers may be represented as negative and positive integers, with a zero value occurring when the ball is resting between the same contacts at which it rested while on a level position. Microprocessor 110 may then determine from this difference (in track numbers) the extent of the slope angle of the green and then access a look-up table to determine the offset distances for various putting distances. The golfer would then determine the putting distance and select the offset distance corresponding to the determined putting distance. As described above, this offset distance represents the distance between cup 55 and a point 56*a* to the right or a point 56*b* to the left of cup 55 where the golfer should aim ball 60 in order to compensate for the measured slope of the green and thereby make the putt.

In addition to displaying the offset distances in step 226, microprocessor 110 stores these values in step 224. Subsequently, microprocessor 110 proceeds to step 228, where it determines whether user switch 126 has been depressed. If it has not been depressed, microprocessor 110 then proceeds to step 234, where it determines whether ball 115 has begun moving again. If not, microprocessor 110 continues to loop through steps 224, 226, 228, and 236 until such time that the switch is depressed or the ball begins moving. If the ball begins moving, microprocessor 110 proceeds to step 238, whereby it clears the display and proceeds back to step 210 as described above.

On the other hand, if in step 228 microprocessor 110 determines that switch 126 has been depressed, microprocessor 110 proceeds to step 230 where it determines whether the switch has been depressed for greater than one second. If switch 126 has been continuously depressed for greater than one second, microprocessor 110 proceeds to step 232, whereby it determines whether switch 126 has been depressed continuously for greater than ten seconds. If so, microprocessor 110 enters the calibration mode and performs the functions outlined above. On the other hand, if switch 126 has been depressed greater than one second but less than ten seconds, microprocessor 110 sets an integration flag and thereby enters an integration mode as indicated in step 240.

The integration mode is used when the golfer either wishes to obtain more measurements of a uniformly sloped green or in such cases when the green slope varies over the course the ball must travel to reach the cup. As described in detail below, the integration mode computes an average slope over a sequence of slope measurements and then displays an offset distance that compensates for all of the measured slopes.

Thus, if the golfer wishes to take multiple measurements for a single putt, the golfer takes a first reading with a device and then presses user switch 126 for more than one second but less than ten seconds. Microprocessor 110 then responds by entering the integration mode in step 240, and then in step 242 stores the last read data as track position data 222 so as to not store subsequent data over the current data in memory. Microprocessor 110 may also send a signal to display 121 to turn on an integration icon (step 244) so that the golfer will know that he or she has entered the device into an integration mode. Microprocessor 110 then proceeds to step 236, where it then continues to loop through steps 224, 226, 228, and 236 until either the switch is again depressed or the microprocessor 110 detects that ball 115 is moving.

Once the ball begins moving again after the integration mode is entered and a first measurement has been stored, microprocessor 110 proceeds to step 238 where it clears the display and returns to step 210 and step 202. This time, when the golfer places the putter down for a subsequent slope measurement, microprocessor 214 determines that the ball is in the track in step 202 and that the ball has stopped moving in step 214. Microprocessor 110 then finds the track number where the ball has come to rest in step 220 and proceeds to step 224 where it determines an average of the measured slopes by reading the previous measured slope data from memory while adding it to the current slope data and dividing it by the number of measurements made following entry into the integration mode. This averaged slope may then be stored in memory and used for subsequent averaging when more slope measurements are taken. Each time another slope is measured, microprocessor 110 computes an offset by accessing the look-up table and determining the offset distances based upon the averaged measured slope. These offset distances are then displayed until the putter is moved and a subsequent measurement is taken and averaged, at which time the offset distances are updated to account for the most recent slope measurement.

To account for the distances over which any particular measured slope may present itself between the ball and the cup, the golfer is instructed to place the club at specific distance intervals between the ball and the cup. The specific distance intervals correspond to the number of measurements the golfer intends to take. Specifically, the golfer is instructed to place the putter at intervals of $1/1+x$ of the putting distance, where x is the number of slope measurements to be taken. For example, if the golfer wishes to take two slope measurements, the golfer is instructed to place the putter first at a position 70*a* on the surface of green 50 that is one-third of the distance to cup 55. Then, after the measurement has been taken, the golfer is instructed to move putter 65 to a position 70*b* that is two-thirds of the distance to cup 55. Thus, by measuring the slope at specific distance intervals, the average slope computed will correspond to the average slope of the surface of green 50 lying between ball 60 and cup 55. To improve the accuracy of this measurement, any number of measurements may be taken at different spaced-apart positions between ball 60 and cup 55. While it is not necessary to take the measurements in any particular order, it may be preferable to take the measurements in a particular sequence either from the ball towards the cup or vice versa, so that microprocessor 110 may take into account the possibility of decreasing ball speed as ball 60 approaches cup 55. Specifically, the slopes measured closest to cup 55 will have more of an impact on the path traveled by ball 60, assuming that ball 60 slows to a significant degree as it approaches cup 55.

Once the golfer has taken all the measurements he or she desires for a given putt, microprocessor 110 displays the offset distances for various putting distances so that the golfer may select the appropriate offset distance for the particular putt. Subsequently, after the putt has been made, the golfer may quickly depress switch 126 for a duration of less than a second, thereby causing microprocessor 110 to detect such a short depression of switch 126 in steps 128 and 230. In response to such a depression of switch 126, microprocessor 110 clears the calibration flag and the integration flag (if they have been set) so as to ensure that the device is no longer operating in either a calibration mode or in an integration mode. At this point, microprocessor 110 also controls display 121 so as to turn off the integration icon. Then, the golf putting aid will be reset for taking subsequent measures for another putt, in which case the average slope measurement stored in the data would be cleared and written over by the data subsequently obtained.

Although the present invention has been described above as mounting housing 20 to the shaft of a putter, it will be appreciated by those skilled in the art that the inventive golf putting aid may be mounted to any other club or club head or, for that matter, to any other structure other than a club, or even not mounted to any device but used as a separate component. While the present invention has also been described as including a display for displaying the information visually to the golfer, the device may be constructed to include an audio circuit so as to audibly provide the information to the golfer. The audio circuit may be included in addition to, or as an alternative to, the display.

The inventive golf putting aid may also be constructed to indicate the actual angle of the measured slope either in addition to, or as an alternative to, displaying the offset distance. As yet another possible modification, the golf putting aid could be configured to include means for inputting the distance of the putt so as to display only a single offset distance corresponding to the input putting distance. Such an input means could correspond to the interface port 128, whereby a keypad may be connected to the device for entry of the putting distance. Alternatively, a global positioning system (GPS) receiver could be plugged into the device so as to automatically and more accurately determine the putting distance.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An electronic golf putting aid comprising:

a level detector for measuring a slope of a golf green and for generating an electrical signal representing the measured slope;

a control circuit coupled to said level detector for receiving the electrical signal and for generating an indicator signal representing information that will aid a golfer while making a putt on the golf green; and an indicator coupled to said control circuit for receiving the indicator signal and for indicating the information represented by the indicator signal to the golfer, wherein the information provided to the golfer includes an offset distance from the hole at which the golfer should aim so as to compensate for the measured slope of the green.

2. The electronic golf putting aid as defined in claim 1, wherein said indicator is a display.

3. The electronic golf putting aid as defined in claim 1, wherein said indicator includes a speaker for audibly indicating the information represented by the indicator signal to a golfer.

4. The electronic golf putting aid as defined in claim 1, wherein the information provided to the golfer includes a plurality of offset distances from the hole at which the golfer should aim so as to compensate for the measured slope of the green, each of the offset distances corresponding to a different putting distance.

5. The electronic golf putting aid as defined in claim 1, wherein the information provided to the golfer includes the measured slope angle.

6. The electronic golf putting aid as defined in claim 1, wherein said level detector includes a chamber having a curved interior surface, an electrically conductive movable element positioned inside said chamber for travelling across said curved interior surface, and a plurality of electrical contacts provided inside said chamber, said electrical contacts being disposed in parallel to one another and perpendicular to a direction of travel of said electrically conductive movable element, and being spaced apart from one another by a distance related to a diameter of said electrically conductive movable element, such that an electrically conductive path is formed between two adjacent electrical contacts when said electrically conductive movable element is disposed therebetween.

7. An electronic golf putting aid comprising:

a level detector for measuring a slope of a golf green and for generating an electrical signal representing the measured slope;

a control circuit coupled to said level detector for receiving the electrical signal and for generating an indicator signal representing information that will aid a golfer while making a putt on the golf green;

an indicator coupled to said control circuit for receiving the indicator signal and for indicating the information represented by the indicator signal to the golfer; and user input means coupled to said control circuit for generating a user input signal when activated by the golfer, wherein said control circuit responds to the user input signal by storing data corresponding to the electrical signal last received from said level detector and integrating data corresponding to a subsequently received electrical signal with the stored data to thereby generate a display signal that represents an offset distance for compensating for an average of at least two measured slopes.

8. A golf putting aid comprising:

a level detector for measuring a slope of a golf green at at least two locations, and for generating electrical signals representing the measured slope at each location;

a control circuit coupled to said level detector for receiving and processing the electrical signals to compute an offset distance from the hole at which a golfer should aim so as to compensate for all of the measured slopes of the green, and for generating an indicator signal representing the offset distance; and an indicator coupled to said control circuit for receiving the indicator signal and for indicating the offset distance to the golfer.

9. The golf putting aid as defined in claim 8, wherein said indicator is a display.

10. The golf putting aid as defined in claim 8, wherein said indicator includes a speaker for audibly indicating the offset distance to a golfer.

11. The golf putting aid as defined in claim 8 and further including user input means coupled to said control circuit for generating a user input signal when activated by the golfer.

12. The golf putting aid as defined in claim 11, wherein said user input means is a reset switch, and said control circuit responds to the user input signal from said reset switch by clearing any stored data that corresponds to the prior measurement of a slope.

13. The golf putting aid as defined in claim 11, wherein said user input means is an integration switch, and said control circuit responds to the user input signal from said integration switch by storing any data that corresponds to the prior measurement of a slope and by integrating the stored data with data corresponding to a subsequently measured slope.

14. The golf putting aid as defined in claim 11, wherein said user input means is a calibration switch, and said control circuit responds to the user input signal from said calibration switch by storing calibration data that corresponds to a measurement of a surface known to be level.

15. The golf putting aid as defined in claim 8 and further including:

a housing in which said slope measuring sensor, control circuit, and indicator are disposed; and a mounting mechanism for removably mounting said housing to a putter.

16. The golf putting aid as defined in claim 15, wherein said mounting mechanism is configured for mounting to the shaft of a putter.

17. The golf putting aid as defined in claim 8 and further including a battery for providing power to said control circuit.

18. The golf putting aid as defined in claim 8, wherein said indicator indicates a plurality of offset distances to the golfer, each of the offset distances corresponding to a different putting distance.

19. The golf putting aid as defined in claim 8, wherein said slope measuring sensor includes a chamber having a curved interior surface, an electrically conductive movable element positioned inside said chamber for travelling across said curved interior surface, and a plurality of electrical contacts provided inside said chamber on said curved surface, said electrical contacts being disposed in parallel to one another and perpendicular to a direction of travel of said electrically conductive movable element, and being spaced apart from one another by a distance related to a diameter of said electrically conductive movable element, such that an electrically conductive path is formed between two adjacent electrical contacts when said electrically conductive movable element is disposed therebetween.

* * * * *